US007989409B2

(12) United States Patent
Poirier et al.

(10) Patent No.: US 7,989,409 B2
(45) Date of Patent: Aug. 2, 2011

(54) GREASE COMPOSITIONS

(75) Inventors: Marc-Andre Poirier, Sarnia (CA); John P. Doner, Sewell, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 206 days.

(21) Appl. No.: 11/880,208

(22) Filed: Jul. 20, 2007

(65) Prior Publication Data

US 2008/0020958 A1 Jan. 24, 2008

Related U.S. Application Data

(60) Provisional application No. 60/832,691, filed on Jul. 21, 2006.

(51) Int. Cl.
*C10M 117/00* (2006.01)
*C10M 111/04* (2006.01)

(52) U.S. Cl. ..... 508/519; 508/467; 508/539; 508/591

(58) Field of Classification Search ..... 508/293, 508/364, 507, 110, 539, 519
See application file for complete search history.

(56) References Cited

U.S. PATENT DOCUMENTS

| | | | | |
|---|---|---|---|---|
| 4,582,616 | A | 4/1986 | Kita et al. | |
| 4,749,502 | A | 6/1988 | Alexander et al. | |
| 5,015,404 | A | 5/1991 | Kubo et al. | |
| 5,059,299 | A | 10/1991 | Cody et al. | |
| 5,190,682 | A | 3/1993 | Harris | |
| 5,558,807 | A | 9/1996 | Kim | |
| 5,650,380 | A | 7/1997 | Fletcher | |
| 5,854,185 | A | 12/1998 | Roth et al. | |
| 5,962,378 | A * | 10/1999 | Tiffany et al. | 508/293 |
| 5,994,278 | A | 11/1999 | Duncan et al. | |
| 6,332,974 | B1 | 12/2001 | Wittenbrink et al. | |
| 6,919,300 | B2 | 7/2005 | Dituro et al. | |
| 2003/0050197 | A1 * | 3/2003 | Akao | 508/280 |
| 2003/0162673 | A1 * | 8/2003 | Kurihara et al. | 508/364 |
| 2004/0037126 | A1 | 2/2004 | Toda et al. | |
| 2004/0167045 | A1 | 8/2004 | Ward et al. | |
| 2005/0014658 | A1 * | 1/2005 | Akao | 508/280 |

FOREIGN PATENT DOCUMENTS

| | | | |
|---|---|---|---|
| EP | 1 602 710 A1 | | 12/2005 |
| GB | 760380 | | 10/1956 |
| GB | 2 408 749 A | | 6/2005 |
| WO | WO2004053030 | * | 6/2004 |
| WO | WO2005097952 | * | 10/2005 |

* cited by examiner

*Primary Examiner* — Ellen M McAvoy
*Assistant Examiner* — Chantel Graham
(74) *Attorney, Agent, or Firm* — Robert A. Migliorini

(57) ABSTRACT

A grease composition is provided that exhibits good low temperature torque and low oil separation. The grease comprises a base oil having a VI greater than about 120, a pour point below about −20° C. wherein the base oil contains about 10 wt % to about 100 wt % of a gas to liquid base stock and from 0 wt % to about 90 wt % of a polyalphaolefin fluid.

24 Claims, No Drawings

GREASE COMPOSITIONS

CROSS-REFERENCE TO RELATED APPLICATION

This application claims the benefit of U.S. Ser. No. 60/832,691 filed Jul. 21, 2006.

FIELD OF THE INVENTION

The present invention relates to a lubricating base oil and grease made therefrom. More particularly, the present invention relates to a grease composition providing among other properties good low temperature torque, low oil separation, improved dropping point and high temperature evaporation properties.

BACKGROUND OF THE INVENTION

Greases are used in a wide variety of applications such as protecting and lubricating mechanical parts like ball and roller bearings and rotating shafts in vehicles, aircraft, machine tools and appliances, to mention but a few. Although greases consist of a lubricant base oil, a thickener and performance enhancing additives, the properties of the grease are due primarily to the properties of the lubricant base oil used in making the grease.

There are many applications for greases that possess simultaneously properties of low evaporation loss at high temperatures and adequate torque at low temperatures, such as lubricating aircraft ailerons, elevators, flaps and the like. However, this combination of properties is difficult to achieve, because lubricant base oils that provide adequate torque at low temperatures typically do not have low evaporation at high temperatures. The present invention is based on the discovery that greases meeting these seemingly incompatible properties can be formulated from Fischer-Tropsch wax derived base oils having high viscosity indicies (VIs).

SUMMARY OF THE INVENTION

In one embodiment of the present invention, a grease composition is provided comprising a lubricant base oil having a VI greater than 120 and a pour point below about −20° C. wherein the base oil contains at least 10 wt % to 100 wt % of a gas to liquid (GTL) base stock and about 0 wt % to 90 wt % of a polyalphaolefin (PAO) fluid. The grease also contains a thickener.

In a preferred embodiment, the grease includes a pour point depressant.

In yet another embodiment, the grease contains at least one performance enhancing additive.

DETAILED DESCRIPTION OF THE INVENTION

The grease composition of the invention comprises a lubricant base oil having a VI of greater than about 120, preferably greater than 130 and a pour point of below about −20° C. and preferably below −25° C. Importantly, the base oil contains about 10 wt % to about 100 wt % and preferably 10 wt % to about 90 wt % of a gas to liquid (GTL) lubricant base stock. Typically the GTL base stock will have a kinematic viscosity (Kv) at 40° C. in the range of from about 10 cSt to about 40 cSt. In the invention the GTL base stock is produced from a waxy, paraffinic Fischer-Tropsch (F-T) synthesized hydrocarbon.

In a F-T synthesis process, a synthesis gas comprising a mixture of $H_2$ and CO is catalytically converted into paraffinic hydrocarbons. The mole ratio of the hydrogen to the carbon monoxide may broadly range from about 0.5 to 4, but is more typically within the range of from about 0.7 to 2.75 and preferably from about 0.7 to 2.5. As is well known, F-T synthesis processes include processes in which the catalyst is in the form of a fixed bed, a fluidized bed or as a slurry of catalyst particles in a hydrocarbon slurry liquid. The stoichiometric mole ratio of $H_2$ and CO for a F-T synthesis reaction is 2.0, but there are many reasons for using other than a stoichiometric ratio as those skilled in the art know. In a cobalt slurry hydrocarbon synthesis process the feed mole ratio of the $H_2$ to CO is typically about 2.1/1.

In the case of a slurry F-T process, the synthesis gas comprising a mixture of $H_2$ and CO is bubbled up into the bottom of the slurry and reacts in the presence of the particulate F-T synthesis catalyst in the slurry liquid at conditions effective to form hydrocarbons, a portion of which are liquid at the reaction conditions and which comprise the hydrocarbon slurry liquid. The synthesized hydrocarbon liquid is separated from the catalyst particles as filtrate by means such as filtration, although other separation means such as centrifugation can be used. Some of the synthesized hydrocarbons pass out the top of the hydrocarbon synthesis reactor as vapor, along with unreacted synthesis gas and other gaseous reaction products. Some of these overhead hydrocarbon vapors are typically condensed to liquid and combined with the hydrocarbon liquid filtrate. Thus, the initial boiling point of the filtrate may vary depending on whether or not some of the condensed hydrocarbon vapors have been combined with it.

Slurry hydrocarbon synthesis process conditions vary somewhat depending on the catalyst and desired products. Typical conditions effective to form hydrocarbons comprising mostly $C_{5+}$ paraffins, and preferably $C_{10+}$ paraffins, in a slurry hydrocarbon synthesis process employing a catalyst comprising a supported cobalt component include, for example, temperatures of from about 320-850° F. (160° C.-455° C.), pressures of from about 80-600 psi (550 kPa-4137 kPa) and hourly gas space velocities in the range of from about 100-40,000 V/hr/V, expressed as standard volumes of the gaseous CO and $H_2$ mixture (0° C., 1 atm) per hour per volume of catalyst, respectively. The term "$C_{5+}$" is used herein to refer to hydrocarbons with a carbon number of greater than 4, but does not imply that material with carbon number 5 has to be present. Similarly other ranges quoted for carbon number do not imply that hydrocarbons having the limit values of the carbon number range have to be present, or that every carbon number in the quoted range is present.

It is preferred that the hydrocarbon synthesis reaction be conducted under conditions in which limited or no water gas shift reaction occurs and more preferably with no water gas shift reaction occurring during the hydrocarbon synthesis. It is also preferred to conduct the reaction under conditions to achieve an alpha (Schultz-Flory kinetic alpha) of at least 0.85, preferably at least 0.9 and more preferably at least 0.92, so as to synthesize more of the more desirable higher molecular weight hydrocarbons. This has been achieved in a slurry process using a catalyst containing a catalytic cobalt component. While suitable F-T types of catalyst comprise, for example, one or more Group VIII catalytic metals such as Fe, Ni, Co, Ru and Re, it is preferred that the catalyst comprise a cobalt catalytic component. In one embodiment the catalyst comprises catalytically effective amounts of Co and one or more of Re, Ru, Fe, Ni, Th, Zr, Hf, U, Mg and La on a suitable inorganic support material, preferably one which comprises one or more refractory metal oxides. Preferred supports for Co containing catalysts comprise titania. Non-limiting examples of useful F-T catalysts and their preparation may be found, in U.S. Pat. Nos. 4,568,663; 4,663,305; 4,542,122; 4,621,072 and 5,545,674.

The GTL basestock is produced by hydromerizing a GTL waxy hydrocarbon product especially one having an initial boiling point in the range of 650° F. to 750° F. and preferably one which continuously boils up to an end point of at least 1050° F. The hydroisomerization of the waxy product, or a portion thereof, may be conducted over a combination of catalysts or over a single catalyst. A particularly preferred hydroisomerization catalyst comprises cobalt, molybdenum and optionally an amorphous silica-alumina component. Examples of catalysts of the type may be found in U.S. Pat. Nos. 5,370,788 and 5,378,348.

Hydroisomerization conversion temperatures typically range from about 150° C. to about 500° C. at pressures ranging from about 500 to 20,000 kPa. This process may be operative in the presence of hydrogen at hydrogen partial pressures ranging from about 600 to 6000 kPa. The ratio of hydrogen to waxy feed typically ranges from about 10 to 3500 $n.1.1^{-1}$ (56 to 19,660 SCF/bbl), and the space velocity of the feed typically ranges from about 0.1 to 20 LHSV.

The hydroisomerate is then dewaxed by reacting it with hydrogen in the presence of a dewaxing catalyst to form a dewaxate from which the light ends are recovered. A dewaxing catalyst that has been found to be particularly effective comprises a noble metal, preferably Pt, composited with H-mordenite. Typical dewaxing conditions include a temperature in the range of about 400 to 600° F. (204° C. to 315° C.), a pressure in the range of about of 500 to 900 psig (3450 kPa to 4140 kPa), a hydrogen treat rate in the range of about 1500 to 3500 SCF/bbl(270 $n.1.1^{-1}$ to 625 $n.1.1^{-1}$) for flow through reactors and LHSV of 0.1 to 10.

In a preferred embodiment, the GTL base oil has a carbon number distribution such that at least 85%, preferably at least 90% of the hydrocarbons, in the base oil have at least 20 carbon atoms. More preferably, at least 90% of the hydrocarbons in the base oil have from 20 to 50 carbon atoms, and most preferably from 22 to 40 carbon atoms.

Optionally, the base oil of the grease of the invention may contain from 0 wt % to 90 wt % and preferably 5 wt % to about 90 wt % of a PAO having a Kv at 40° C. in the range of about 5 cSt to about 40 cSt. PAO oil base stock is a commonly used synthetic hydrocarbon oil. By way of example, PAO's derived from $C_8$, $C_{10}$, $C_{12}$, $C_{14}$ olefins or mixtures thereof may be utilized. See U.S. Pat. Nos. 4,956,122; 4,827,064; and 4,827,073.

The number average molecular weights of the PAO's, which are known materials and generally available on a major commercial scale from suppliers such as ExxonMobil Chemical Company, Chevron, BP-Amoco, and others, typically vary from about 250 to about 3000, or higher, and PAO's may be made in viscosities up to about 100 $mm^2/s$ (100° C.), or higher. In addition, higher viscosity PAO's are commercially available, and may be made in viscosities up to about 3000 $mm^2/s$ (100° C.), or higher. The PAO's are typically comprised of relatively low molecular weight hydrogenated polymers or oligomers of alpha-olefins which include, but are not limited to, about $C_2$ to about $C_{32}$ alphaolefins with about $C_8$ to about $C_{16}$ alphaolefins, such as 1-octene, 1-decene, 1-dodecene and the like, being preferred. The preferred polyalphaolefins are poly-1-octene, poly-1-decene and poly-1-dodecene and mixtures thereof and mixed olefin-derived polyolefins. However, the dimers of higher olefins in the range of about $C_{14}$ to $C_{18}$ may be used to provide low viscosity base stocks of acceptably low volatility. Depending on the viscosity grade and the starting oligomer, the PAO's may be predominantly trimers and tetramers of the starting olefins, with minor amounts of the higher oligomers, having a viscosity range of about 1.5 to 12 $mm^2/s$.

PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. Nos. 4,149,178 or 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

The grease of the invention includes a thickener. Typical thickeners include alkali metal soaps, clays, polymers, silica gels and polyureas. In the present invention alkali metal soaps, especially lithium soaps, are the preferred thickeners. Typically, the lithium soaps are derived from a lithium base and $C_{10}$ to $C_{24}$ and preferably $C_{15}$ to $C_{18}$ fatty acids, conveniently, 12-hydroxystearic acid. Also useful are lithium complex soaps, i.e., soaps formed from a lithium base and a mixture of such fatty acids.

The grease of the invention contains preferably about 1 wt % to about 25 wt % and more preferably about 2 wt % to about 15 wt % of thickener based on the total weight of the grease composition.

Various conventional grease additives may be incorporated into the compositions of the invention to improve desirable properties such as oxidation stability, tackiness, extreme pressure properties and corrosion inhibition. A description of the additives used in greases can be found, for example, in "Modern Lubricating Greases," 1976, Chapter 5.

In a preferred embodiment of the invention, the grease composition will contain a pour point depressant. Pour point depressants are well known and typically comprise $C_8$ to $C_{18}$ dialkylfumarate/vinyl acetate copolymers and polymethacrylates. Typically, the pour point depressant will comprise about 0.1 wt % to about 1 wt % and preferably 0.2 wt % to 0.4 wt % of the total grease composition. A particularly preferred pour point depressant is an alkylated fumarate/vinyl acetate copolymer.

When a grease composition is formulated as described above, it will possess the properties of low evaporation loss at high temperatures, e.g., above about 100° C., and adequate torque at low temperatures, e.g., below about −70° C. as required, for example, by the U.S. Military specification MIL-PRF-23827, or the Boeing specification, BMS 3-33.

The invention will be further illustrated by the following nonlimiting examples.

EXAMPLE 1

The evaporative weight losses for five lubricant base stocks were determined and are given in Table 1 along with their Kvs (ASTM D 445) and VIs (ASTM D 457). As can be seen, the GTL base stocks (Base stocks 1 and 2) have relatively low evaporative losses after 22 hours at 100° C. Also, the GTL base stocks have higher VIs than Base stocks 4 and 5 although all Base stocks 1 and 4 and Base stocks 2 and 5 have about the same Kv at 100° C.

TABLE 1

| Base stock | 1 wt % | 2 wt % | 3 wt % | 4 wt % | 5 wt % |
|---|---|---|---|---|---|
| PAO 2 | 0 | 0 | 100.0 | 0 | 0 |
| PAO 4 | 0 | 0 | 0 | 100.0 | 0 |
| PAO 6 | 0 | 0 | 0 | 0 | 100.0 |
| GTL 3.6 | 100.0 | 0 | 0 | 0 | 0 |
| GTL 6 | 0 | 100.0 | 0 | 0 | 0 |
| Properties | | | | | |
| KV @ 40° C., cSt | 14.68 | 29.68 | 5.10 | 16.46 | 30.28 |
| KV @ 100° C., cSt | 3.66 | 6.05 | 1.70 | 3.79 | 5.79 |
| VI | 139 | 157 | 144 | 122 | 137 |
| Evaporative Losses, wt % 22 hrs @ 100° C. | 0.23 | 0.74 | 6.23 | 0 | 0.03 |

This example shows that the GTL base stocks have relatively low evaporation losses after 22 hours at 100 C; and for a given viscosity at 100 C, the GTL base stocks have a higher VI than the PAO base stocks. Higher VIs are indicative of better low and high temperature properties.

EXAMPLE 2

A series of base oils were prepared by blending two PAO base stocks, two GTL base stocks or one GTL base stock with one PAO base stock. These base stocks were blended to meet a viscosity target of about 15 cSt at 40C. Table 2 shows the composition of the blends (base oils) and their properties.

TABLE 2

| Base stock | Base Oil 6 wt % | Base Oil 7 wt % | Base Oil 8 wt % | Base Oil 9 wt % | Base Oil 10 wt % | Base Oil 11 wt % | Base Oil 12 Wt % |
|---|---|---|---|---|---|---|---|
| PAO 2 | 40.7 | 34.3 | 30.1 | 0 | 0 | 0 | 7 |
| PAO 4 | 0 | 0 | 0 | 0 | 0 | 50.0 | 93 |
| PAO 6 | 59.3 | 65.7 | 69.9 | 10.0 | 0 | 0 | 0 |
| GTL 3.6 | 0 | 0 | 0 | 90.0 | 90.0 | 50.0 | 0 |
| GTL 6 | 0 | 0 | 0 | 0 | 10.0 | 0 | 0 |
| Properties | | | | | | | |
| KV @ 40° C., cSt | 13.61 | 15.30 | 16.55 | 15.70 | 14.74 | 15.48 | 15.05 |
| KV @ 100° C., cSt | 3.36 | 3.63 | 3.83 | 3.82 | 3.84 | 3.71 | 3.56 |
| VI | 121 | 123 | 125 | 139 | 141 | 130 | 118 |
| Evaporative Losses, wt % | | | | | | | |
| 22 hrs @ 100° C. | 3.07 | 2.63 | 2.41 | 0.19 | 0.31 | 0.13 | 0.35 |
| HC Distribution, wt %* | | | | | | | |
| $C_{20}$ | 44.8 | 38.3 | 34.1 | 0 | 0 | 0 | 6.96 |
| $C_{30}$ | 19.6 | 21.4 | 23.3 | 90.3[1] | 100.0[1] | 93.8[1] | 81.61 |
| $C_{40}$ | 27.4 | 31.0 | 32.9 | 7.6 | 0 | 6.0 | 10.99 |
| $C_{50}$ | 7.6 | 8.6 | 8.9 | 2.0 | 0 | 0.2 | 0.44 |
| $C_{60}$ | 0.6 | 0.7 | 0.8 | 0.1 | 0 | 0 | 0 |

As can be seen, while all the blends have a similar viscosity, not all the blends meet the U.S. Military Specification, MIL-PRF-23827 requirement of 2 wt % maximum evaporation loss for greases such as aircraft greases. Also, base oils 6, 7 and 8 prepared solely with PAO base stocks have high evaporative weight losses. Base oils 9, 10 and 11 meet the military weight loss requirements and have desirably higher VIs than base oil 12.

In a preferred embodiment, the base oil has a carbon number distribution such that at least 85%, preferably at least 90% of the hydrocarbons in the base oil have at least 20 carbon atoms. Most preferably, at least 90% of the hydrocarbons in the base oil have from 20 to 50 carbon atoms, conveniently from 22 to 40 carbon atoms.

EXAMPLE 3

Three greases were prepared, one from Base Oil 11 (Grease 1) and one from Base Oil 12 (Grease 2) using about 12-14 wt % of the same lithium soap thickener, lithium 12-hydroxystearate. A third grease (Grease 3) was a commercially available grease that contained a mixture of PAO and di-isooctyl azealate base oil and a lithium complex thickener. These greases were subjected to the tests shown in Table 3.

TABLE 3

| | Test | Grease 1 | Grease 2 | Grease 3 |
|---|---|---|---|---|
| 60X Penetration | ASTM D217 | 237 | 306 | 298 |
| Cu Corrosion, 24 hrs @ 100° C. | ASTM D4048 | 1A | 1A | 1B |
| Rust Protection, 48 hrs @ 125° F. | ASTM D1743 | Pass | Pass | Pass |
| Dropping Point, ° C. | ASTM D2265 | 245 | 198 | 220 |
| 4-Ball Wear, Scar Diam, mm | ASTM D2266 | 0.44 | 0.422 | 0.518 |

TABLE 3-continued

| | Test | Grease 1 | Grease 2 | Grease 3 |
|---|---|---|---|---|
| Oil Separation, 30 hrs @ 100° C. | ASTM D6184 | 0.31 | 4.82 | 4.4 |

This example shows that a grease of this invention (Grease 1) has some properties similar to Greases 2 and 3 but significantly lower oil separation than Greases 2 and 3.

EXAMPLE 4

0.3 wt % of an alkylated fumarate/vinyl acetate copolymer pour point depressant sold by Infineum Corporation, Linden, N.J., under the trade name Infineum V387 was added to Grease 1 from Example 3. As shown in Table 4, the addition of the pour point depressant to Grease 1 significantly reduced the low temperature running torque at −73° C. and did not affect the low temperature starting torque at −73° C. or the U.S. Steel Mobility, a widely used measure of grease flow.

TABLE 4

| | Test | Grease 1 | Grease 1 |
|---|---|---|---|
| Infineum V387, wt % | | 0 | 0.3 |
| Properties | | | |
| Low Temp. Running Torque @ −73° C. | ASTM D1478 | 0.317 Nm | 0.227 Nm |
| Low Temp. Starting Torque @ −73° C. | ASTM D1478 | 1.0199 Nm | 1.0885 Nm |
| US Steel Mobility, 0° F., g/min | | 129.0 | 129.2 |

EXAMPLE 5

To better compare the low temperature torque properties of a grease of the invention, 30 wt % of Base Oil 11 of Example 2 was added to Grease 1 of Example 3 to make it a softer grease (Grease 4). The Grease 4 was subjected to the tests shown in Table 5, which for comparative purposes also includes results for Greases 2 and 3.

TABLE 5

| Properties | Test | Grease 2 | Grease 3 | Grease 4 | MIL-PRF-23827 |
|---|---|---|---|---|---|
| 60X Penetration | ASTM D217 | 306 | 298 | 309 | |
| Low Temp. Running Torque @ −73° C. | ASTM D1478 | 0.084 Nm | 0.051 Nm | 0.052 Nm | 0.10 Nm max |
| Low Temp. Starting Torque @ −73° C. | ASTM D1478 | 0.654 Nm | 0.464 Nm | 0.681 Nm | 1.0 max |

As can be seen, Grease 4 has a better low temperature running torque than Grease 2, made with 100% PAO base oil.

EXAMPLE 6

The oxidation and hydrolytic stability of a blend of a GTL base stock and a PAO base stock of the invention and of commercial Grease 3 were determined in accordance with ASTM D943, which was run for 10 days at 95° C. using 20 wt % water. The results are given in Table 6.

TABLE 6

| | Base Oil 11* wt % | Base Oil 12 wt % |
|---|---|---|
| Base Stock | | |
| PAO 4 | 50.0 | 80.0 |
| GTL 3.6 | 50.0 | 00 |
| Diisononyl Adipate | 0 | 20.0 |

TABLE 6-continued

| | Base Oil 11* wt % | Base Oil 12 wt % |
|---|---|---|
| Properties | | |
| ASTM D 943 Acid Number, mg KOH/g | 0.006 | 10.8 |

*Same fluid as in Table 2 used to make the grease used in Examples 3, 4 and 5.

The high acid number of the PAO base oil (Base Oil 12) can lead to reduced grease life and corrosion of metal components if not properly neutralized in the grease formulation.

What is claimed is:

1. An improved grease composition as evidenced by low oil separation and evaporation loss properties, said composition comprising:

(a) a lubricant base oil having a VI greater than 120 and a pour point below about −20° C. and less than 2 wt % evaporative losses after 22 hours at 100° C. wherein the base oil consists essentially of about 10 wt % to about 95 wt % of a gas to liquid (GTL) base stock and about 5 wt % to 90 wt % of a PAO fluid and in which base oil at least 85% of the hydrocarbons in the oil have at least 30 carbon atoms; and (b) a grease thickener.

2. The grease of claim 1 wherein the PAO has a Kv at 40° C. in the range of about 5 cSt to about 40 cSt.

3. The grease of claim 1 wherein the GTL base stock has a Kv at 40° C. in the range of from about 10 cSt to about 40 cSt.

4. The grease of claim 3 wherein the GTL base oil is produced from a Fischer-Tropsch synthesized waxy hydrocarbon.

5. The grease of claim 4 further comprising a pour point depressant.

6. The grease of claim 5 wherein the thickener is a lithium soap.

7. The grease of claim 6 further comprising at least one performance enhancing additive.

8. An improved grease composition as evidenced by low oil separation, low evaporation loss and reduced low temperature running torque properties, said composition comprising (a) a lubricant base oil having a VI greater than 120, a pour point below about −20° C. and a Kv at 40° C. in the range of about 10 cSt to about 100 cSt and less than 2 wt % evaporative losses after 22 hours at 100° C. wherein the base oil consists essentially of 10 wt % to 95 wt % of a GTL base stock and from 5 wt % to 90 wt % of a PAO having a Kv at 40° C. in the range of 10 cSt to 100 cSt and in which base oil at least 85% of the hydrocarbons in the oil have at least 30 carbon atoms; (b) a thickener; (c) a minor amount of a pour point depressant; and (d) at least one additional grease additive.

9. The composition of claim 8 wherein the thickener is a lithium soap or lithium complex soap.

10. A grease composition comprising:

(a) a base oil consisting essentially of

−10 wt % to 90 wt % of a lubricating oil formed by (i) hydroisomerizing a paraffinic, Fischer-Tropsch synthesized waxy hydrocarbon to form a hydroisomerate, (ii) catalytically dewaxing the hydroisomerate to form a dewaxate which contains low boiling hydrocarbons, (iii) removing the lower boiling hydrocarbons to obtain the base oil wherein the base oil is formed under conditions whereby the base oil has a VI greater than 120 and a pour point below −20° C., and −10 wt % to 90 wt % of a PAO oil having a Kv at 40° C. in the range of 10 cSt to 40 cSt, said base oil having less than 2 wt % evaporative losses after 22 hours at 100° C., and at least 85% of hydrocarbons in the oil have at least 30 carbon atoms;

(b) a grease thickener, and (c) optionally a minor amount of a pour point depressant whereby said grease composition has improved oil separation when compared to a grease prepared with the same thickener and pour point depressant but with a base oil consisting essentially of a PAO.

11. The grease of claim 10 wherein the thickener is present in an amount of from about 2 wt % to about 15 wt % based on the total weight of the composition.

12. The grease of claim 11 wherein the thickener is a lithium soap or lithium complex soap.

13. The grease of claim 12 wherein a pour point depressant is present in an amount ranging from about 0.2 wt % to about 0.4 wt % based on the total weight of the composition.

14. The grease of claim 13 wherein the pour point depressant is an alkylated fumarate/vinyl acetate copolymer.

15. A method for reducing the oil separation of a grease comprising a lubricant base oil and a grease thickener, the method comprising using as the lubricant base oil one having a VI greater than 120 and a pour point below about −20° C. and having less than 2 wt % evaporative losses after 22 hours at 100° C., and which base oil contains about 10 wt % to about 90 wt % of a gas to liquid (GTL) base stock and about 5 wt % to about 90 wt % of a PAO fluid, and wherein at least 85% of the hydrocarbons in the oil have at least 30 carbon atoms.

16. The method of claim 15 wherein the PAO has a Kv at 40° C. in the range of about 5 cSt to about 40 cSt.

17. The method of claim 15 wherein the GTL base stock has a Kv at 40° C. in the range of from about 10 cSt to about 40 cSt.

18. The method of claim 15 wherein the GTL base oil is produced from a Fischer-Tropsch synthesized waxy hydrocarbon.

19. The method of claim 18 wherein the grease further comprises a pour point depressant.

20. The method of claim 15 wherein the thickener is a lithium soap.

21. The method of claim 15 including at least one performance enhancing additive.

22. The grease of claim 1 wherein at least 90% of the base oil is hydrocarbons having 30 to 50 carbon atoms.

23. The grease of claim 10 wherein at least 90% of the base oil is hydrocarbons having 30 to 50 carbon atoms.

24. The method of claim 15 wherein at least 90% of the base oil is hydrocarbons having 30 to 50 carbon atoms.

* * * * *